US005678331A

United States Patent [19]

Bonaventure

[11] Patent Number: 5,678,331

[45] Date of Patent: Oct. 21, 1997

[54] SKI BOOT

[75] Inventor: Laurent Bonaventure, Cran-Gevrier, France

[73] Assignee: Salomon S.A., Annecy, France

[21] Appl. No.: 559,449

[22] Filed: Nov. 15, 1995

[30] Foreign Application Priority Data

Nov. 18, 1994 [FR] France ..... 94 14064

[51] Int. Cl.[6] ..... A43B 5/04

[52] U.S. Cl. ..... 36/117.1; 36/118.2; 36/118.4; 36/118.7

[58] Field of Search ..... 36/117.1, 118.2, 36/118.3, 118.4, 118.5, 118.7, 118.8, 118.9

[56] References Cited

U.S. PATENT DOCUMENTS

| | | | |
|---|---|---|---|
| 4,095,356 | 6/1978 | Robran et al. | 36/118.4 |
| 4,769,929 | 9/1988 | Sartor | 36/118.5 |
| 4,918,842 | 4/1990 | Lederer | 36/118.9 |
| 5,065,532 | 11/1991 | Gorza | 36/118.9 |
| 5,191,728 | 3/1993 | Paris et al. | 36/118.9 |
| 5,345,698 | 9/1994 | Billet et al. | 36/118.9 |
| 5,381,613 | 1/1995 | Pozzobon et al. | 36/117.1 |

FOREIGN PATENT DOCUMENTS

| | | | |
|---|---|---|---|
| 286 586 | 10/1988 | European Pat. Off. . | |
| 470 383 | 2/1992 | European Pat. Off. . | |
| 504 769 | 9/1992 | European Pat. Off. . | |
| 2 334 315 | 7/1977 | France . | |
| 2 662 057 | 4/1991 | France . | |
| 2656776 | 7/1991 | France | 36/118.2 |
| 2 692 446 | 6/1992 | France . | |

OTHER PUBLICATIONS

Search Report FR 94 14064.

*Primary Examiner*—M. D. Patterson
*Attorney, Agent, or Firm*—Pollock, Vande Sande & Priddy

[57] ABSTRACT

Front- and/or central-entry ski boot equipped with a comfort sock (3) and having an upper/collar (4) made adjustable over the lower leg by transverse flaps (1) and closure systems (13). The upper (4, 44) is jointed around an axis (5) on the shell base (6) in the area of the malleoli and can pivot only in the forward direction, since a permanent stop-motion arrangement (14) on the shell base (6) prevents it from pivoting rearwardly. The shell base (6) incorporates, in the dorsal area of the heel (16), a vertical groove (17) open at the top and designed to allow passage of the rear-most point (20) of the heel (22) of the skier's foot when the boot is put on and removed, by deformation of the comfort sock (3) at that site, and a retractable flap (18), jointed by its lower part (19) to the shell base (6) in the area of the heel, closes this groove (17) in the skiing position of the boot by virtue of the action exerted on an actuating device (35) which also tightens it against the rear part of the skier's leg via the interposed comfort sock (3).

11 Claims, 5 Drawing Sheets

SKI BOOT

FIELD OF THE INVENTION

The present invention relates to ski boots of the front- or central entry type comprising an upper/collar articulated to a shell base and capable of pivoting forward only, means preventing it from pivoting rearward, and, in particular, to a device which facilitates the passage of the heel of the skier's foot into the upper when the boot is put on and taken off.

BACKGROUND OF THE INVENTION

Ski boots of the front entry type normally comprise a slit, so-called "variable volume" shell closed by overlapping transverse flaps fastened to closure systems, and any rearward pivoting motion of the uppers/collars of these boots is blocked in order to ensure good quality rear support. In conventional fashion, the upper/collar is immobilized by means of two shoulders in the area of the boot heel-piece, one being located on the lower edge of the upper/collar, and the other in a corresponding position on the shell base. The two shoulders form functional stops only when pressure is exerted on the upper/collar to make it pivot rearward, and, accordingly, they allow the upper/collar to pivot forward freely, potentially counter to the elastic resistance of a so-called "flection-control" mechanism or device. One significant advantage of this type of boot, in which the rearward motion of the upper is blocked, lies in the ability to vary the internal volume of the shell by virtue of transverse flaps that can be fitted in an especially effective way to the foot, these flaps acting on the closure systems so as to accommodate the volume of the foot. Another advantage lies in the fact that the skier can easily gauge the position of the upper so as to place his foot in the extended position as close as possible to the median longitudinal axis of the upper, which substantially coincides with the axis of insertion. On the other hand, one disadvantage related to the opening of the upper when putting on or taking off the boot makes these boots difficult and troublesome to manipulate. Indeed, these boots, resembling those described, for example, in FR 2 433 311 and EP 358 599, require a large opening in the front area of the upper, which is closed by transverse flaps, so as to allow insertion of the instep and the rear-most part of the heel, which, since it is stopped against the rear portion of the upper, forces the instep forward. The upper opening must, in fact, allow insertion of the inserted periphery of the foot, i.e., the periphery running through the instep and the rearmost point of the heel, or, in other words, the front and rear bony protuberances of the foot when extended.

This problem related to the opening is also posed with respect to the boot described in Application No. FR 2 334 315, in which deformable zones are provided to allow, using a tightening mechanism, either the heel to be immobilized in the skiing position or the heel to be released to allow the boot to be put on or taken off.

As described and disclosed, these deformable zones and the tightening mechanism are positioned and function essentially on the lateral faces of the boot, opposite the portion of the skier's foot delimited substantially by the malleolus, the heel, and the Achilles tendon. Accordingly, in the skiing position, it is possible, using the tightening mechanism, to immobilize the heel on the bottom of the boot by retightening these zones above the lateral protuberances of the heel after the foot has been inserted into the boot. The rear zone of the upper thus remains undeformable, as in the boots described in FR 2 433 311 and EP 358 599, and this type of boot fitted with deformable lateral zones thus also requires a wide opening of the front zone of the upper, in order to allow insertion of the insertion periphery of the foot, i.e., the periphery extending through the instep and the rearmost point of the heel. In consequence, wide-spread practice includes the use of closure systems incorporating buckles, which release completely the transverse flaps or tongues closing the front part of the upper. In fact, the requisite existence of a significant potential for enlarging the opening is virtually impossible to restore solely using closure systems equipped with permanent connecting members. In consequence of this need to open the flaps on the front part of the upper to allow the boot to be put on or removed, closure of the upper after the boot has been put on requires that these flaps be drawn together manually in order to re-engage the hooking mechanism of the closure systems.

Other boots, again of the front-entry type (e.g., as disclosed by DE 39 19 661) incorporate, in the area of the front part of the foot, a cover extending along the longitudinal axis the boot and jointed at the end of thereof. This cover, which avoids the use of flaps in the front area of the upper, does not, however, avoid the necessity to releasing this front area entirely to allow insertion of the foot, and, in particular, of the instep toward the front, since, in addition, the heel cannot move backward against the rear part of the upper.

In other rear- and/or front-entryboots, a solution designed to facilitate the act of putting on or removing the boot consists in allowing the upper/collar to swivel rearward by means of a rigid clamp extensible between an upper-immobilization position, the so-called "skiing" position, and a release position which frees the rear zone of the upper and allows it to pivot. As an example, boots of this kind are described in EP 286 586 and EP 470 383, and in Application No. FR 2 341 283. The solution, consisting of the release of the boot upper toward the rear in order to facilitate the removal and/or insertion of the foot, does not, however, obviate the need to open completely the flaps closing the front portion of the upper in order to clear the way for the instep. Moreover, because of this ability of the upper to pivot rearward, these boots must be fitted with comfort socks which can very freely pivot rearward in conjunction with the upper. The socks thus designed are complicated and expensive, thereby increasing enormously the overall cost of these ski boots.

Finally, while the release of the upper in such boots allows removal of the foot with relative ease, the same is not true of insertion. In fact, since the upper is free to pivot from front to back and vice-versa, the skier can no longer use the upper as a reference point to direct his foot when extended as close as possible to the median longitudinal axis of the upper which, in boots having immobilized uppers, coincides with the axis of insertion.

These problems arising from putting on and removing the boot and requiring a large opening of the front portion of the upper are not posed in rear-entryboots, in which the upper comprises a rear and a front cover jointed to the shell base. In fact, to open these boots, as described, for example, in U.S. Pat. No. 4,095,356, it is necessary only to pivot the rear cover toward the rear without having to release the front part of the upper, and the foot can be inserted easily, since the heel rubs against the rear portion of the upper only when the front part of the foot and the instep protuberance are almost entirely inserted in the shell base. On the other hand, these boots, in which the upper opens in a tulip-shaped configuration, require, in contradistinction to the front-entry boots, a pivoting motion of sizable magnitude of the rear cover to allow the foot to be inserted. Because this rearward pivoting motion produces a sizable opening of the top portion of the upper, it is virtually mandatory to disconnect the closure systems completely. Indeed, if these systems are simply open, that is, without being unhooked, the relaxation they can produce remains insufficient for insertion of the instep.

To conclude, rear-entryboots are easy to put on and take off, but they simply shift the upper-opening problem from the front to the rear portion. Moreover, closure of these boots also requires that the rear cover be manually drawn closer to the front cover in order to reengage the closure systems.

This type of rear-entry boot poses another difficulty concerning the quality of the rear support, which can no longer be provided in the heel area. In fact, since the rear cover must remain free to pivot rearward to open the upper, the most conventional solution consists in immobilizing the front cover to prevent any rearward pivoting motion and to connect the rear cover to the upper in order to hold it in the closed position, thereby guaranteeing rear support of the skier's lower leg. In this structure, the immobilization and/or position-retention area located on the front and top of the foot is located at a distance from the rear zone where the forces are generated. Accordingly, the plastic component parts of the boot become elastically deformed, and the various clearances produced using the upper-closure systems are eliminated before the rear cover opposes effective resistance and, therefore, effective support.

SUMMARY OF THE INVENTION

The present invention seeks to solve the problems linked to the opening of boot uppers and which arise when the boots are put on or removed, while preserving optimal quality of the rear support and of the tightening of the boot on the foot.

Another object of the invention is to allow the use of upper-closure systems that need not be completely disconnected, at least in the instep/flection fold area, thereby avoiding the need to draw the transverse flaps of the shell closer together manually.

To achieve these objects, the front- or central-entry ski boot according to the invention is equipped with a comfort sock and comprises an upper/collar adjustable over the skier's lower leg using transverse flaps and closure systems, said upper/collar being jointed around an axis located on a shell base substantially in the area of the malleoli and capable of pivoting forward only, since the permanent stop-motion means arranged on the shell base prevent it from pivoting rearwardly. The shell base of the boot is provided in the dorsal area of the heel, with a vertical groove open at the top and designed to allow passage of the rearmost point of the skier's heel when the boot is put on and taken off, and a retractable flap jointed by its lower portion of the shell base in the area of the heel, closes the groove in the position in which the boot is used for skiing by acting on an actuating device also ensuring that it is tightened against the rear part of the skier's lower leg by means of the interposed comfort sock. This characteristic allows the boot to be put on very easily by clearing a sizable passage for the heel, but without requiring a large opening of the upper and of the shell base, in particular in the instep/flection fold area.

Another significant advantage deriving from this boot structure relates to the use of a wide range of comfort socks. In fact, because of the limited opening of the boot upper required, and thus of the upper part of the sock, virtually all types of socks can be used, whether of the front- and/or rear-entry type, and/or also of the "boot" type, whether extensible or openable. However, it is preferable that the socks incorporate, in the area corresponding to the vertical groove in the shell base, an elastically-deformable area permitting deformation of the sock in this area to allow passage of the skier's heel when the boot is put Preferably, in the skiing position the upper part of the retractable flap fits, by means of a support zone, beneath a lower, rear shoulder of the upper/collar, thereby reinforcing the rearward immobilization of the upper/collar in a manner complementing the action of the permanent stop-motion means arranged on the shell base, thus guaranteeing an extremely effective rear support.

In this way, the invention proposes a ski boot combining features relating to rear support and tightening of the shell of a front-entry boot and to ease of putting on such a boot as regards the insertion of the foot along the axis of insertion of the boot, with features relating to a rear-entry boot facilitating passage of the heel, without requiring a large opening of the upper and of the shell base in the area corresponding to the instep/flection fold.

The retractable flap exists in the form of a vertically-positioned half-cylinder whose two wings advantageously extend inside the vertical groove in the shell base. By means of this arrangement, the retractable flap can pivot around its joint on the shell base in the area of the heel, without being hindered by the edges delimiting the vertical groove.

The device for actuating the retractable flap comprises a device controlling this flap, such as a lever/tensioning device, and at least one inextensible connecting member supported on at least one reversing device located on the flap, this connecting member being connected on one side to this control device and, on the other side, to at least one of the sides of the upper/collar. Accordingly, when the retractable lever is closed, any forward flection of the upper/collar pulls on the inextensible connecting member which, since it is supported on the flap, causes this flap to follow the motion of the upper/collar.

According to one embodiment, the inextensible connecting member forms a half-loop whose middle engages with the lever/tensioning device, while each of its ends is anchored on a side of the collar upper in a substantially symmetrical manner.

According to one variant, one of the ends of the connection member is anchored on one of the sides of the upper/collar, and the other is fastened to the free end of a transverse tightening and closing flap extending on the other side of this upper/collar. In this way, when the retractable flap is closed over the vertical groove by means of the actuating device, the upper/collar is tightened over the skier's lower leg at the same time the flap is tightened against the rear portion of the lower leg.

In order to vary the closed position of the retractable flap in relation to the groove in the direction of the skier's leg, a mechanism for adjusting the functional length of the inextensible connection member is joined to the latter.

The boot structure described above shows that the joints of the upper/collar and of the retractable flap are separated from each other, one being located in the area of the malleoli, and the other in the heel area. The device actuating the flap in relation to the upper/collar functions in the upper part of the retractable flap in the area of the heel, and therefore, well above these joints and substantially in a straight line with the flap joint. As a result, when the upper/collar bends forward, the upper part of the flap follows the motion of the upper, but in a downward circular path, while the path described by the rear shoulder of the upper/collar extends upward. This divergence of the two paths, which causes a relative sliding motion of the retractable flap in relation to the rear portion of the upper/collar, consequently generates a degree of travel of the inextensible connection member which, depending on the relative position of its reversing device on the flap and on its anchored position on the upper/collar, is pulled to a relatively pronounced degree. Since it is inextensible, the flap-closing connection member can, also play a role in the forward flection of the upper, depending on whether this connection member is more or less rapidly brought to maximum tension, a position in which it then immobilizes the upper/collar. In order to vary the tensioning of the connection member as a function of the desired forward flection (amplitude, stress, etc.), the anchoring position of the end (or ends) of the connection member is made adjustable in height in relation to the position of the reversing device (or devices) located on the retractable flap.

According to a variant of the device actuating the retractable flap, the control mechanism, e.g., the lever/tensioning device, simultaneous controls two inextensible connection members, one being designed to ensure that the flap follows the motion of the upper/collar, and the other being designed to control the forward flection of the latter, in particular by determining a retention position as a function of a determinate pivoting motion. In this construction, the first connection member is preferably anchored at a specific height on the sides of the upper/collar below the position of the reversing device on the flap, so that, by pivoting forward around its axis located in proximity to the malleoli, the upper/collar pulls substantially as much of the length of the connection member as the flap releases while pivoting around its joint located in the heel area. On the other hand, the second connection member is anchored in the rear portion of the upper/collar, substantially in a straight line with the flap joint located on the shell base, in the heel area. By means of this configuration, the circular path described by the interposed control device, the lever-tensioning device, and the second connection member, and adjustment of the length of this second connection member allows precise determination of the position from which one wishes to obtain position-retention of the upper/collar in forward flection.

According to another feature of the invention, the retractable flap is continuously acted upon by an elastic mechanism which causes it to swing automatically out of the vertical groove allowing passage of the skier's heel, when the device actuating this flap is in the boot-opening position. This configuration allows "automatic" opening of the flap when the lever/tensioning device is operated, thereby greatly facilitating the process of putting on the boot.

In addition, given once again the reduced opening of the flaps needed to put on and remove the boot, the invention makes it possible to provide a continuous, sliding connection of the rivet/oblong slot type between at least one pair of flaps in the front instep/flection fold area, independently of the closure systems. This sliding connection gives uniform position-maintenance of the flaps between themselves and of the facing hooking parts of the closure systems, even if the shell of the boot tends to become deformed and/or to twist at the time pronounced stresses are generated during skiing.

BRIEF DESCRIPTION OF THE DRAWINGS

The invention will be better understood from the following description provided with reference to the attached schematic drawings illustrating by way of example several embodiments of the invention.

FIG. 1 shows the boot closed over the skier's foot in the skiing position.

FIG. 2 shows the release of the retractable flap by opening its actuating device.

FIG. 3 shows the insertion of the skier's foot in the boot.

DETAILED DESCRIPTION

Figure 4:
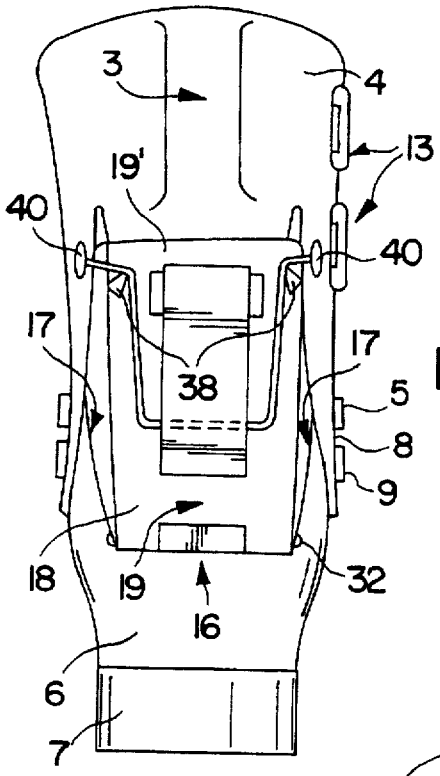
FIG. 4 is a rear view of the closed boot in FIG. 1.

The ski boot 1 illustrated in FIGS. 1, 2, 3 and 4 is a front-entry boot, since only the front area 2 can be opened. It comprises an upper/collar 4 closed in its rear portion 15 and jointed in the area corresponding to the malleoli around two axes 5 on a shell base 6 fitted with a sole 7.

The upper/collar 4 and the shell base 6 are closed, respectively, by transverse flaps 10 and 11, which are subjected to the action of closure systems 13 designed to tighten them against the skier's foot and/or lower leg.

A cover 12 extending over the flaps 11 on the shell base 6 and the flaps 10 of the upper/collar 4 contributes to the impermeability of the boot and to the distribution of tightening stresses.

According to one feature, the upper/collar 4 is prevented from any rearward pivoting motion, and permanent stop-motion means 14 located toward the rear, which cooperate with the rear edge of the upper/collar 4 and which are shown schematically in the drawings by means of a triangle 14, are positioned on the sides of the shell base 6 at a height substantially greater than that of the axes 5.

In this embodiment, the upper/collar 4 is fitted with flexible lugs 8 extending beyond the axes 5, and these flexible lugs 8 are attached by rivets 9 to the sides of the shell base 6. In this way, the upper/collar 4 can pivot forward around the axes 5 only by overcoming the elastic resistance generated in opposition by the flexible lugs 8, the latter thus giving a degree of control of flection.

A comfort sock 3, of the front-opening type in this example, is interposed between the shell base 6 and the skier's foot. The comfort sock incorporates an elastically deformable wall in the zone positioned in correspondence with a vertical, substantially rectangular groove 17 in the dorsal area of the heel 16 of the shell base 6. Groove 17 is open at the top and, in the skiing position, is closed by a retractable flap 18 jointed by its lower part 19 to a substantially horizontal axis 32 connecting it to the shell base 6.

The retractable flap 18 has, when seen vertically, the shape of a half-cylinder whose wings extend inside the vertical groove 17 and below edges delimiting it, that is, below the sides of the shell base 6, which extend upward on either side of the boot up to the area in which the upper-collar 4 located above the area of the malleoli is tightened, as shown by the dotted lines in FIG. 1.

A device 35 for actuating the flap 18 and comprising a lever 36, and a flexible, inextensible connection member 37 interacts between this flap 18 and the upper/collar 4 in order to ensure the closure of the groove 17 and a tightening action against the rear part of the skier's lower leg located just above the heel, because of the action exerted on the flap 18. Preferably, an elastic mechanism 47, constituted, for example, by an extension of the upper/collar 4 in continuous contact with the retractable flap 18, is provided, in order to cause the automatic pivoting motion of flap 18 as soon as lever 36 is opened.

In this embodiment, the inextensible connection member 37 forms a half-loop whose middle is engaged with the lever 36, while each of its ends 40 is anchored on a side of the upper/collar 4, substantially at the same height as the reversing devices 38, which are arranged symmetrically on the flap 18 and cooperate with this same connection member 37.

Figure 1:
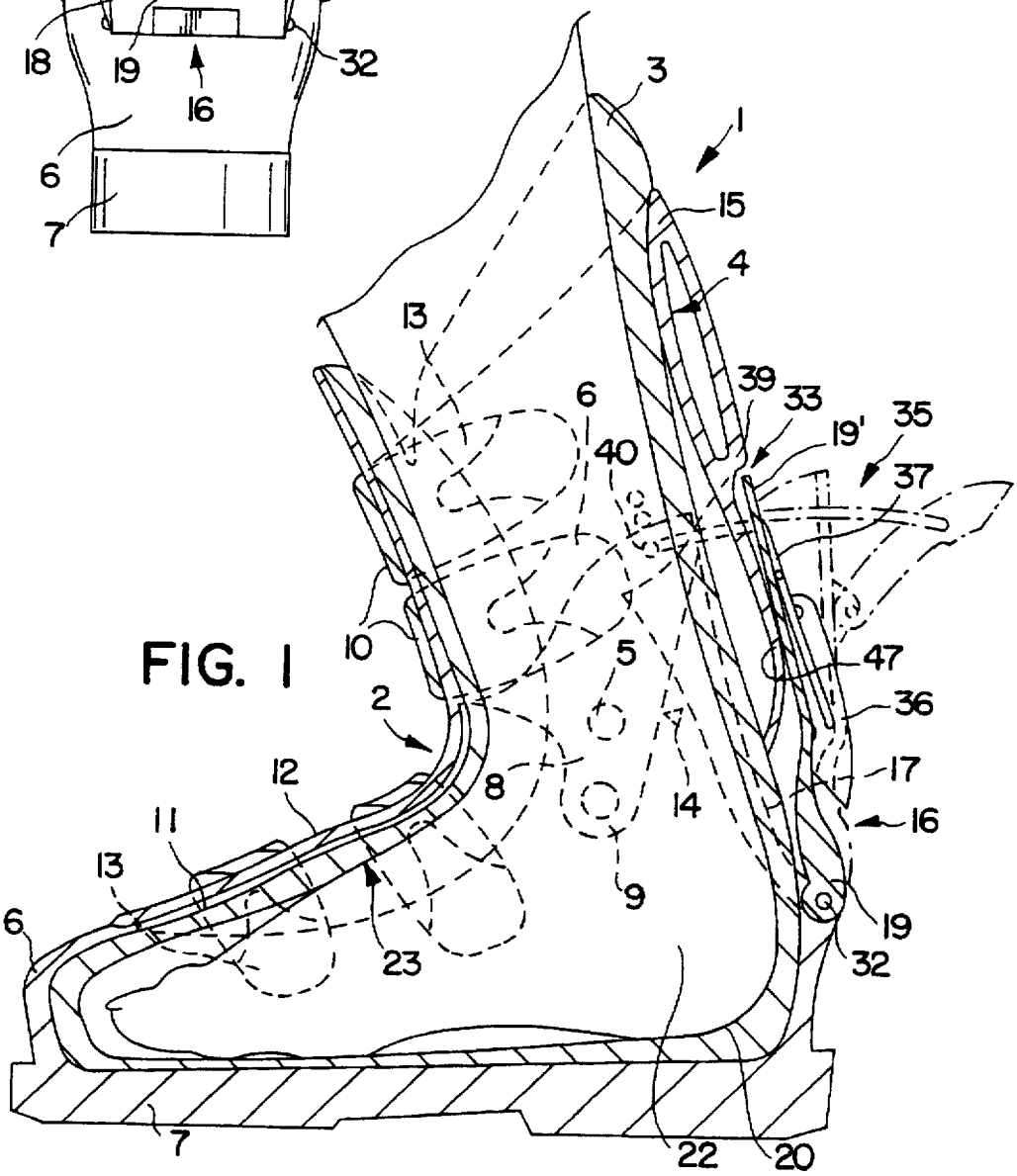
FIGS. 1, 2 and 3 illustrate, in longitudinal cross-section, a ski boot according to the invention during different stages of the process of putting on and removing the boot.
Figure 2:
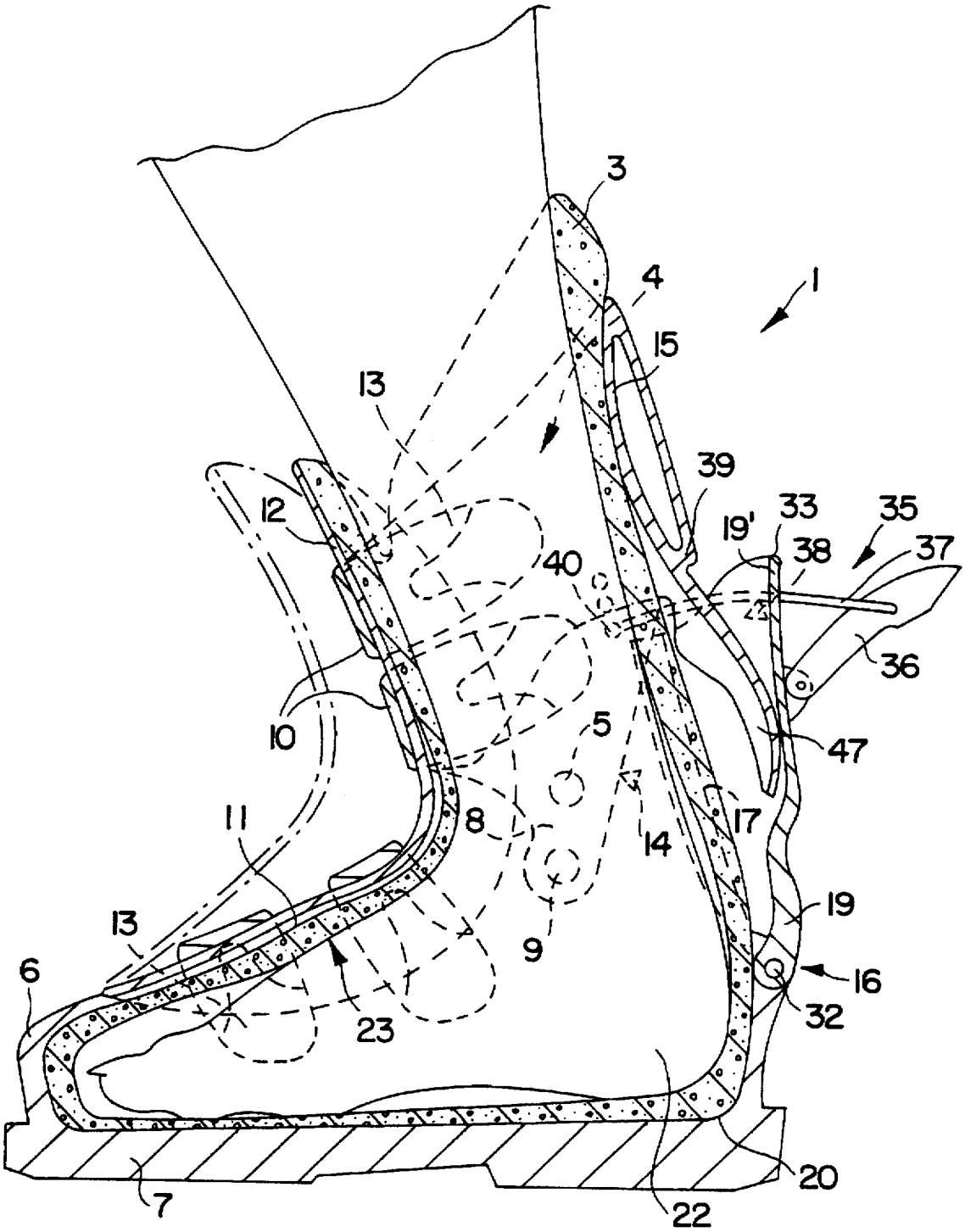

Preferably, the upper part 19' of the flap 18 fits, by means of a support area 33, beneath the lower shoulder 39 of the upper/collar 4 when the device 35 places the flap 18 in the groove 17-closure position, as illustrated in FIG. 1.

Thus, the upper/collar 4, which is prevented from any rearward pivoting motion because of the stop-motion means 14 arranged on the sides of the shell base 6, is also blocked from moving rearward by the lower rear shoulder 39 in contact with the support area 33, thereby strengthening the quality of the rear support.

To permit adjustment of the closure position of flap 18 in relation to the rear part of the skier's lower leg, the inextensible connection member 37 may advantageously be made adjustable on the lever 36.

In addition, to modify the front-flection movement of the upper/collar 4, several anchoring points 40 are provided on the sides of the upper/collar 4, at different heights. Thus, for example, by selecting a high anchoring point 40 a high degree of position-retention restricting flection of the upper/collar 4 is obtained, while, by selecting a very low anchoring point 40, a high degree of pivoting motion of the flap 18 as it follows the upper/collar 4 is obtained, with virtually no position-retention effect.

It is obvious that the different anchoring points 40 may be replaced by a micrometrically-adjustable system, such as a connection-coupling slider screwed onto a threaded rod. By rotating the threaded rod in one direction or the other, the position of the connection-coupling slider is modified.

According to an advantageous embodiment (not shown) one of the ends 40 of the inextensible connection member 37 controlled by the lever/tensioning device 36 may be connected to the free end of a transverse flap 10 on the upper/collar 4, 44 in order to tighten it around the skier's lower leg, while, at the same time, the retractable flap 18 is tightened against the rear part of the lower leg at the site of the vertical groove 17 allowing passage of the heel.

Figure 3:
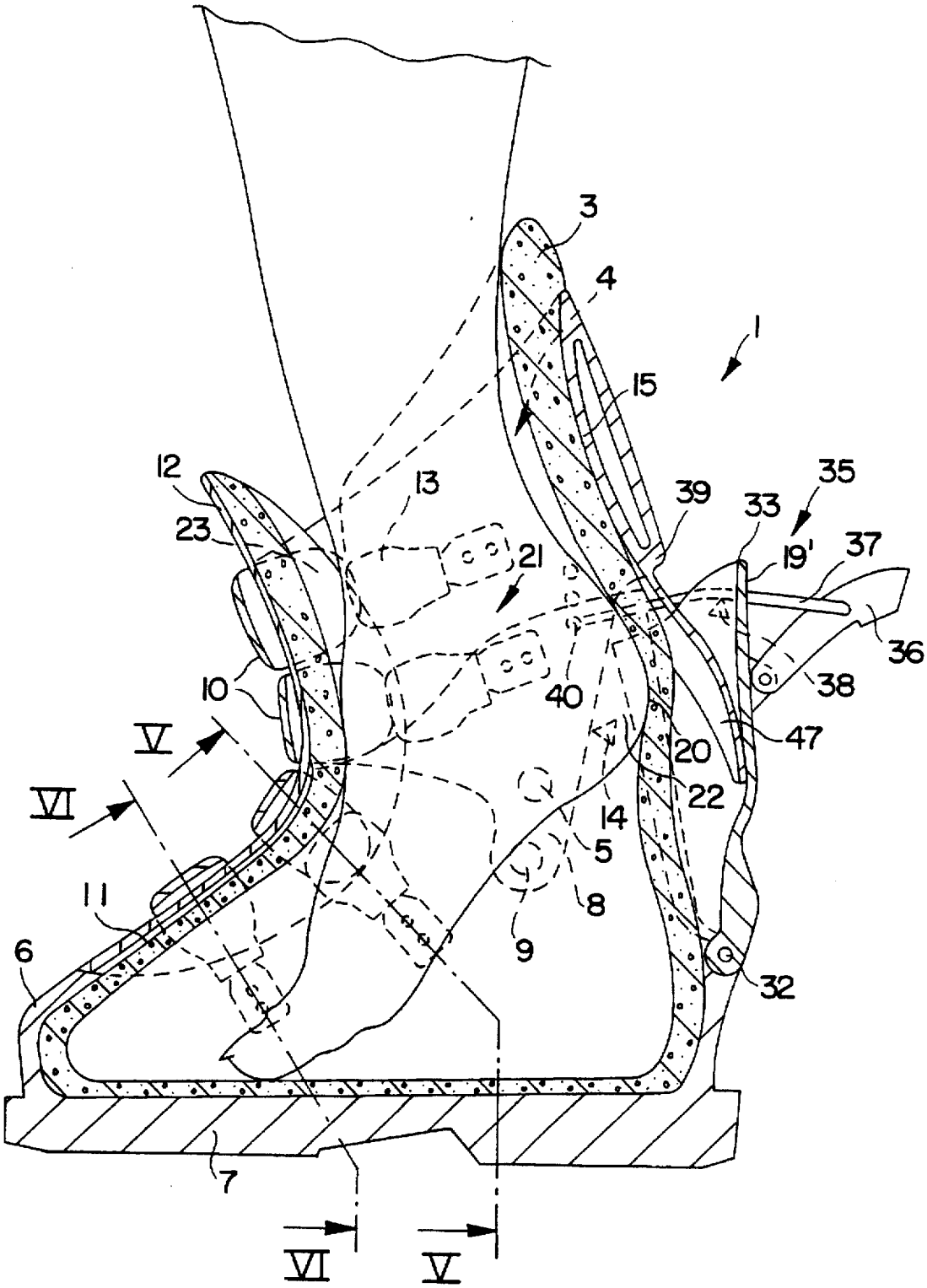

According to the invention, the vertical groove 17 is designed to allow passage of the rear-most point 20 of the skier's heel 22 when the foot 21 is removed and/or inserted in the boot, as illustrated in FIG. 3, e.g., by deformation of the comfort sock 3 at this location. In this case, the sock preferably incorporates a zone made of an elastically-deformable material.

Because of the possibility of moving the heel 22 of the foot 21 backward into the area of the heel-piece 16 of the shell base 6, the instep 23 is not pushed forward, and simple extension of the foot 21 alone is required to allow the foot 21 to move easily into or out of the boot.

Consequently, the flaps 11 and 10 on the shell base 6 and the upper/collar 4 located in the areas corresponding to the instep/flection fold do not have to be open completely, and accordingly the closure systems 13 located in proximity do not have to be disconnected.

Figure 5:
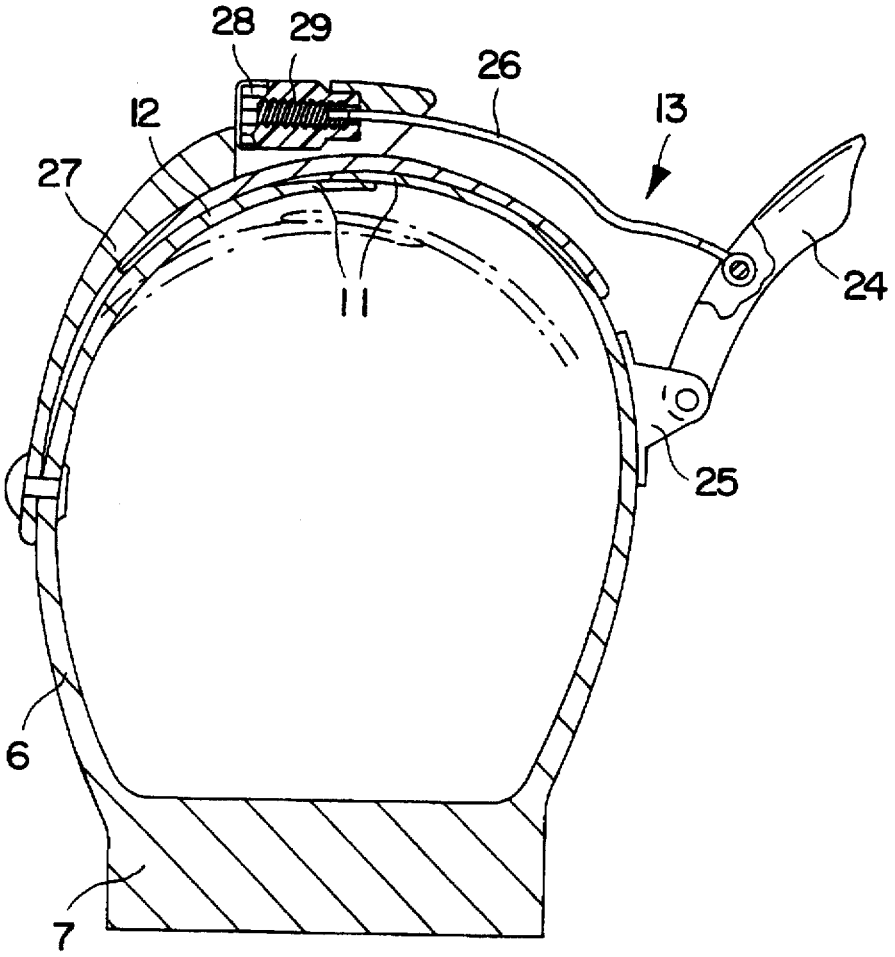
FIG. 5 is a cross-section along line V—V of the ski boot in FIG. 3, showing the opening of the closure system located in the instep area.

This configuration is illustrated in FIG. 5, which shows the flaps 11 on the shell base 6 located in the instep area. As a construction example, the closure system 13 comprises a lever/tensioning device 24 mounted on a clevis 25 attached to a flap 11 and a tractive connection member 26, which is attached on one side to lever 24, and on the other side to a collar 27 integral with the other flap 11, this collar 27 partially overlapping the cover 12 ensuring the impermeability of these flaps 11.

To allow a tightening adjustment of the flaps 11 over the comfort sock and, therefore, over the skier's foot (not shown in FIG. 5), the tractive connection member 26 is made adjustable in length, for example by using a knurled wheel 28 enclosed by the collar 27 and in which a threaded end-piece 29 forming its coupling end is screwed.

Figure 6:
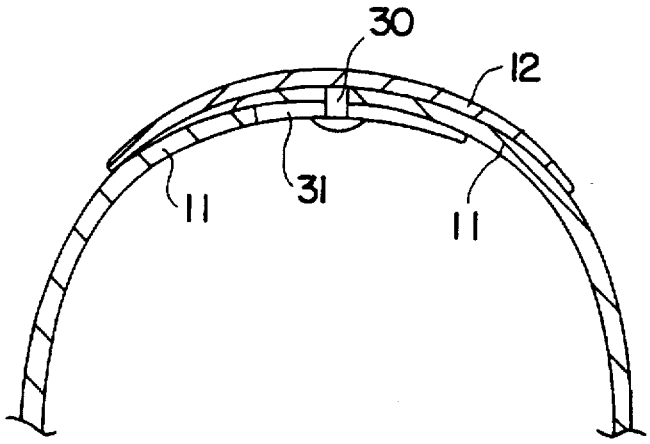
FIG. 6 is a partial cross-section along line VI—VI of the ski boot in FIG. 3, illustrating a permanent sliding connection of the overlapping flaps located in the anterior region of the foot.

As shown in FIG. 6, because the flaps 11, or 10 in the case of the upper/collar, need no longer be completely spaced apart from each other, a continuous sliding connection produced with a rivet 30 and an oblong slot 31 may be arranged between them.

Figure 7:
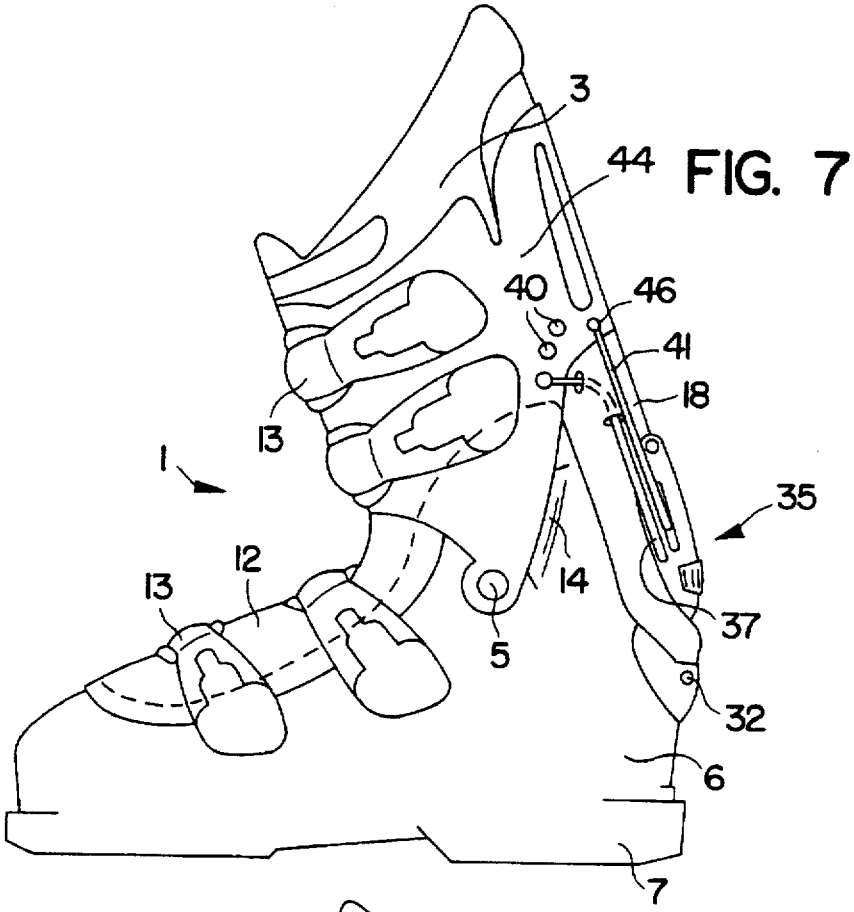
FIGS. 7 and 8 are side views of a boot according to the invention, illustrating the actuation of two connection members by means of the device controlling the retractable flap, one of these connection members being designed to ensure that the flap will "follow" the upper/collar, and the other to ensure control of the forward flexion of the upper.
Figure 8:
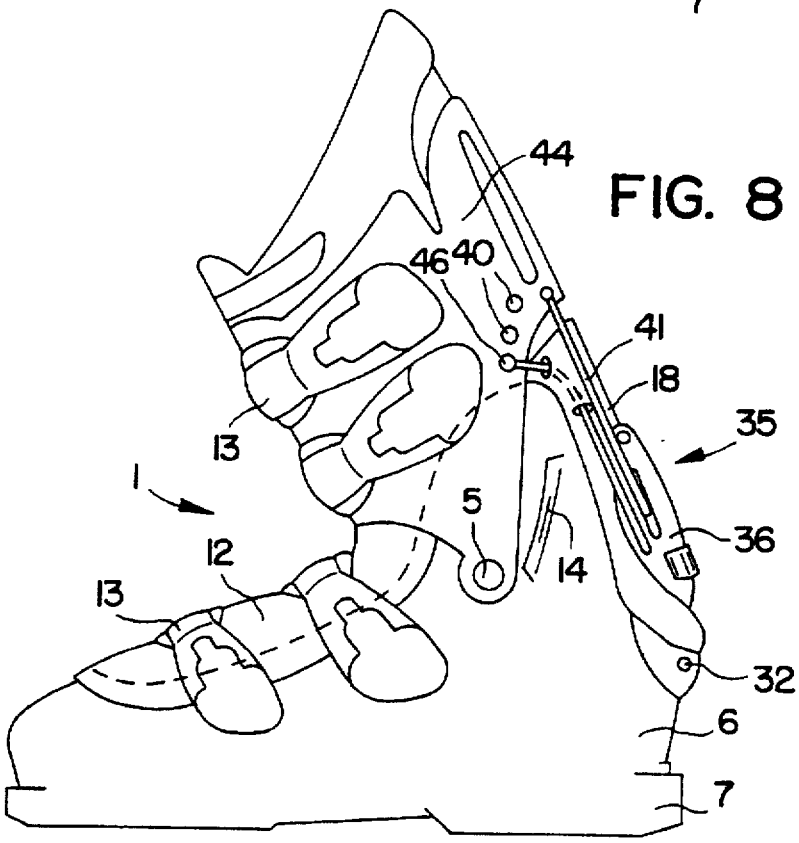

According to a variant shown in FIGS. 7 and 8, the device actuating the flap 18 is fitted with a second inextensible connection member 41 designed to ensure specifically the control of forward flection of the upper/collar 44. To this end, the second connection member 41 extends over the dorsal area of the boot and is anchored at 46 in the rear portion 3 of the upper/collar 44. Placing the lever 36 in the closure position thus stretches this connection member 41 substantially in the plane passing between its anchoring point 46 and the jointing axis 32 of the flap 18.

In this construction, the first connection member 37 ensures that the flap 18 will follow the upper/collar 44, and the second connection member 41 ensures flection control, i.e., the pivoting amplitude of the upper/collar 44 allowed before the pivoting motion is actually restricted. The length of this second connection member 41 is preferably made adjustable, since it is this length which determines the amplitude of the pivoting motion of the upper/collar.

Still according to this variant, the upper/collar 44 has no lugs 8, as in the case of the upper/collar 4 and can, therefore pivot forward around its joints 5, in the absence of elastic resistance in the area of its attachment to the shell base 6. It will be understood that the stop-motion means 14 located on the sides of the shell base 6 block the rearward motion of the upper/collar 44, as in the case of the upper-collar 4.

What is claimed is:

1. A front entry ski boot fitted with a comfort sock and comprising an upper, transverse flaps and closure systems for adjusting said upper over a lower leg, said upper being jointed around an axis on a shell base cooperating with permanent stop-motion means arranged on the shell base which prevent it from pivoting rearward, wherein a dorsal area of a heel of the shell base incorporates a vertical groove having an open top and allowing passage of a rearmost point of a heel of a foot of a skier when the boot is put on or taken off, and a retractable flap jointed by its lower portion to the shell base in the area of the heel, said flap being adapted to close said groove in a position of use of the boot for skiing by means of the action exerted on an actuating device, which also tightens said flap against the rear part of a skier's leg.

2. The ski boot according to claim 1, wherein, in a skiing position, the upper part of the retractable flap fits beneath a lower rear shoulder in the upper by means of a support area.

3. The ski boot according to claim 1, wherein the flap has the overall shape of a vertically-positioned half-cylinder, of which two wings extend inside the vertical groove produced in the shell base.

4. The ski boot according to claim 1, wherein the actuating device actuating the retractable flap is a tensioning device connected to an inextensible connection member in the shape of a half-loop supported on reversing devices located on the flap and having ends which are anchored on sides of the upper.

5. The ski boot according to claim 4, wherein the inextensible connection member comprises means for adjusting a length of a connection designed to vary the flap-closure position toward the rear part of the skier's leg.

6. The ski boot according to claim 5, wherein one of the ends of the inextensible connection controlled by the tensioning device is connected to a free end of a transverse flap on the upper, in order to tighten it around the skier's lower leg at the same time that the retractable flap is tightened against the rear part of the skier's leg at the site of the vertical groove allowing passage of the heel.

7. The ski boot according to claim 4, wherein including means for adjusting a height of the ends of the inextensible connection member on the sides of the upper in relation to the position of the reversing device located on the retractable flap.

8. The ski boot according to claim 1, wherein an elastic mechanism automatically causes pivoting of the retractable flap out of the groove allowing passage of the heel of the skier's foot when the device actuating this flap is placed in the boot-opening position.

9. The ski boot according to claim 1, wherein the actuating device actuating the retractable flap controls a connection member restricting a forward pivoting motion of the upper.

10. The ski boot according to claim 9, wherein the connection member restricting the forward pivoting motion of the upper is an inextensible connection member, means being provided to adjust a length of said connection member, in order to vary the position from which position-retention becomes operative.

11. The ski boot according to claim 1, wherein the comfort sock incorporates a zone made of elastically deformable material and located in correspondence with the vertical groove of the shell base.

* * * * *